US010500891B2

(12) United States Patent
Kajiwara et al.

(10) Patent No.: US 10,500,891 B2
(45) Date of Patent: Dec. 10, 2019

(54) MECHANICAL PENCIL

(71) Applicant: KABUSHIKI KAISHA PILOT CORPORATION, Tokyo-to (JP)

(72) Inventors: Takumi Kajiwara, Kanagawa-ken (JP); Nobukazu Seri, Kanagawa-ken (JP); Atushi Ishikawa, Kanagawa-ken (JP); Yuji Kawarazaki, Kanagawa-ken (JP)

(73) Assignee: KABUSHIKI KAISHA PILOT CORPORATION, Tokyo-To (JP)

( * ) Notice: Subject to any disclaimer, the term of this patent is extended or adjusted under 35 U.S.C. 154(b) by 57 days.

(21) Appl. No.: 15/740,510

(22) PCT Filed: Jun. 24, 2016

(86) PCT No.: PCT/JP2016/068863

§ 371 (c)(1),
(2) Date: Dec. 28, 2017

(87) PCT Pub. No.: WO2017/002731

PCT Pub. Date: Jan. 5, 2017

(65) Prior Publication Data

US 2018/0186173 A1 Jul. 5, 2018

(30) Foreign Application Priority Data

Jun. 29, 2015 (JP) ..... 2015-130240
Dec. 24, 2015 (JP) ..... 2015-252071

(51) Int. Cl.
*B43K 21/16* (2006.01)
*B43K 21/027* (2006.01)
*B43K 21/22* (2006.01)

(52) U.S. Cl.
CPC ..... *B43K 21/16* (2013.01); *B43K 21/027* (2013.01); *B43K 21/22* (2013.01)

(58) Field of Classification Search
CPC ..... B43K 21/16; B43K 21/027; B43K 21/22; B43K 21/00; B43K 21/003; B43K 21/006;
(Continued)

(56) References Cited

U.S. PATENT DOCUMENTS 4,315,695 A * 2/1982 Alves dos Santos .. B43K 24/10 401/107
4,377,349 A * 3/1983 Kunii ..... B43K 24/03 24/11 R
8,794,857 B2 * 8/2014 Handrinos ..... B43K 21/00 401/115

FOREIGN PATENT DOCUMENTS

JP 58-89393 6/1983
JP 60-78491 5/1985
(Continued)

OTHER PUBLICATIONS

Notification of Reason for Rejection dated Feb. 21, 2018 in corresponding Taiwanese Application No. 105120328, with English Translation.
(Continued)

*Primary Examiner* — David J Walczak
(74) *Attorney, Agent, or Firm* — Wenderoth, Lind & Ponack, L.L.P.

(57) ABSTRACT

A mechanical pencil including: a body cylinder; a lead releasing unit configured to release a writing lead and having a rear region supported inside the body cylinder such that a front region thereof is flexurally deformable or tiltable inside the body cylinder; and a stretchable elastic body arranged between the lead releasing unit and a body cylinder, in which the lead releasing unit has a pressed portion on an outer circumferential surface of the front region, the body cylinder has a pressing portion in a front region, the pressing portion and the pressed portion abut on each other before the front
(Continued)

region of the lead releasing unit is flexurally deformed or tilted, and the pressing portion causes the pressed portion to relatively move to the rear side with respect to the body cylinder when the front region of the lead releasing unit is flexurally deformed or tilted.

12 Claims, 11 Drawing Sheets

(58) Field of Classification Search
CPC ..... B43K 21/02; B43K 21/033; B43K 21/04; B43K 21/06; B43K 24/02; B43K 24/03
See application file for complete search history.

(56) References Cited

FOREIGN PATENT DOCUMENTS

| | | |
|---|---|---|
| JP | 61-71488 | 5/1986 |
| JP | 2000-62383 | 2/2000 |
| JP | 2007-223256 | 9/2007 |
| JP | 2012-11692 | 1/2012 |
| JP | 2013-252661 | 12/2013 |
| JP | 2015-123689 | 7/2015 |
| TW | 580458 | 3/2004 |
| TW | 200706404 | 2/2007 |
| TW | 200940359 | 10/2009 |
| TW | 201402356 | 1/2014 |

OTHER PUBLICATIONS

International Search Report dated Sep. 6, 2016 in corresponding International Application No. PCT/JP2016/068863.
Extended European Search Report dated Feb. 20, 2019 in corresponding European Application No. 16817839.0.

* cited by examiner

| ANGLE OF TAPERED SURFACE θ (°) | 12.5 | 20 | 27.5 | 35 | 42.5 | 50 |
|---|---|---|---|---|---|---|
| LEAD PULL-IN AMOUNT d1(mm) | 2.7 | 1.6 | 1.2 | 0.9 | 0.7 | 0.5 |
| ECCENTRICITY AMOUNT d2(mm) | MAXIMUM 0.6 | | | | | |
| WORKING LOAD WHEN INITIAL SPRING FORCE IS 370gf (gf) | 391 | 360 | 331 | 303 | 275 | 246 |

MECHANICAL PENCIL

TECHNICAL FIELD

The present invention relates to a mechanical pencil that enables writing by releasing a writing lead from a tip end of a ferrule by a predetermined amount by a clicking operation or the like.

BACKGROUND ART

Conventionally, there is a problem that the writing lead exposed from the tip end of the ferrule is easily broken when high writing pressure is applied to the writing lead when writing is performed using the mechanical pencil. If the writing pressure is constant, the writing lead is more easily broken as an angle between an axial direction of a body cylinder of the mechanical pencil and a paper surface becomes smaller (as the body cylinder is laid down) or as a length of the writing lead exposed from the tip end of the ferrule becomes longer.

With respect to such a problem, Patent Literature 1 (JP 2015-123689 A) discloses a mechanical pencil that reduces breakage of a writing lead when high writing pressure is applied to the writing lead by absorbing a component in an axial direction of the writing pressure and a component vertical to the axial direction of the writing pressure using different mechanisms, respectively.

Specifically, a ferrule is supported by a body cylinder via an elastic body (coil spring), and the ferrule has a cam slope that gradually decreases in diameter toward a rear side in the axial direction in the mechanical pencil disclosed in Patent Literature 1. In addition, a pressing portion that presses the cam slope in a front side in the axial direction is formed in the body cylinder. With such a configuration, the cam slope of the ferrule is pressed to the front side in the axial direction by the pressing portion of the body cylinder due to the component vertical to the axial direction of the writing pressure (a force in a radially outward direction of the body cylinder), and the ferrule slides forward (pops out) from a tip end of the body cylinder. Accordingly, the length of the writing lead exposed from the tip end of the ferrule is decreased.

Further, a lead releasing unit that releases the writing lead is supported by the body cylinder to be relatively movable in the axial direction in the state of being biased to the front side in the axial direction (in a ferrule tip end direction in the axial direction) by the elastic body (coil spring) in the mechanical pencil of Patent Literature 1. Then, the component in the axial direction of the writing pressure is absorbed as the lead releasing unit including the writing lead relatively moves to the rear side in the axial direction with respect to the body cylinder. As a result, the length of the writing lead exposed from the tip end of the ferrule is further reduced so that the breakage of the writing lead is decreased.

CITATION LIST

Patent Literature

Patent Literature 1: JP 2015-123689 A

In the mechanical pencil described in Patent Literature 1, the ferrule slides (pops out) at once over a maximum length (stroke) in which the ferrule can slide forward with respect to the body cylinder when the high writing pressure is applied to the writing lead.

On the other hand, the inventor of the present invention has developed a configuration in which a writing lead slides rearward with respect to a ferrule when high writing pressure is applied to the writing lead, and confirmed that there are many users who feel a smoother writing feeling with such a configuration.

The present invention is made on the basis of the above findings, and an object thereof is to provide a mechanical pencil with the smooth writing feeling that is capable of reliably avoiding the breakage of the writing lead when the high writing pressure is applied to the writing lead.

SUMMARY OF INVENTION

The present invention relates to a mechanical pencil including: a body cylinder; a lead releasing unit which is configured to release a writing lead and has a rear region that is supported inside the body cylinder such that a front region thereof is flexurally deformable or tiltable inside the body cylinder; an overhanging portion provided on an outer circumferential surface of the front region of the lead releasing unit; a protruding portion provided on an inner circumferential surface on a rear side in an axial direction than the overhanging portion of the body cylinder; and a stretchable elastic body arranged in a compressed state between the overhanging portion and the protruding portion. The lead releasing unit has a pressed portion on the outer circumferential surface of the front region. The body cylinder has a pressing portion in a front region. At least one of the pressing portion and the pressed portion is a tapered surface which gradually increases in diameter toward the rear side in the axial direction. The pressing portion and the pressed portion abut on each other before the front region of the lead releasing unit is flexurally deformed or tilted inside the body cylinder. The pressing portion causes the pressed portion to relatively move to the rear side in the axial direction with respect to the body cylinder when the front region of the lead releasing unit is flexurally deformed or tilted inside the body cylinder.

According to the present invention, when the high writing pressure is applied to the writing lead, the front region of the lead releasing unit is flexurally deformed or tilted inside the body cylinder due to a component vertical to the axial direction of the writing pressure. In this manner, the lead releasing unit including the writing lead is relatively moved to the rear side in the axial direction with respect to the body cylinder against a biasing force of the elastic body, and thus, a length of the writing lead exposed from a tip end of a ferrule is decreased. Further, the lead releasing unit including the writing lead is further relatively moved to the rear side in the axial direction with respect to the body cylinder against the biasing force of the elastic body due to the component in the axial direction of the writing pressure so that the length of the writing lead exposed from the tip end of the ferrule is further decreased. As a result, the breakage of the writing lead can be reliably avoided when the high writing pressure is applied to the writing lead. In addition, at this time, the ferrule is not relatively moved (pops out) to a front side in the axial direction with respect to the body cylinder, but the lead releasing unit including the writing lead is relatively moved to the rear side in the axial direction with respect to the ferrule so that the length of the writing lead exposed from the ferrule is decreased. Accordingly, it is possible to provide the mechanical pencil with the smooth writing feeling.

Preferably, the pressed portion of the lead releasing unit is the tapered surface, the tapered surface has any angle between 20° and 60° with respect to the axial direction of the body cylinder, the elastic body is a coil spring, and a load, necessary to relatively move the pressed portion to the rear side in the axial direction with respect to the body cylinder against a biasing force of the coil spring, is any value between 0.5 N and 8 N.

In this case, when the high writing pressure is applied to the writing lead, the lead releasing unit including the writing lead can be relatively moved to the rear side in the axial direction with respect to the body cylinder reliably, and thus, the breakage of the writing lead is reliably avoided. On the other hand, when appropriate writing pressure is applied to the writing lead, the lead releasing unit including the writing lead is not relatively moved substantially to the rear side in the axial direction with respect to the body cylinder, and thus, there is no loss of writing feeling.

Alternatively, preferably, the pressed portion of the lead releasing unit is the tapered surface, the tapered surface has any angle between 20° and 60° with respect to the axial direction of the body cylinder, the elastic body is configured by arranging a first coil spring and a second coil spring in series, a load, necessary to relatively move the pressed portion to the rear side in the axial direction with respect to the body cylinder against a biasing force of the first coil spring, is any value between 0.5 N and 5 N, and a load, necessary to relatively move the pressed portion to the rear side in the axial direction with respect to the body cylinder against a biasing force of the second coil spring, is any value between 2 N and 10 N.

In this case, the writing pressure is absorbed by the first coil spring which starts to be compressed and deformed with a relatively small load and the second coil spring which starts to be compressed and deformed with a relatively large load, stepwise in this order, and thus, it is possible to optimize a sense of resistance due to the biasing force of the elastic body when the lead releasing unit including the writing lead is relatively moved to the rear side in the axial direction with respect to the body cylinder.

In addition, preferably, the lead releasing unit includes: a lead pipe which extends in the axial direction of the body cylinder inside the body cylinder; a connector which is fixed to a front end portion of the lead pipe and has a protrusion formed on an outer circumferential surface thereof; a chuck which is fixed to a front end portion of the connector; a fastening ring which is externally fitted to a front region of the chuck; a return spring which biases the connector to the rear side in the axial direction; and a weight body which is provided so as to be loosely fitted to an outer circumference of the lead pipe in a space portion formed between the body cylinder and the lead pipe, and the weight body is configured to move back and forth inside the space portion when the body cylinder is swung back and forth and to abut on the protrusion of the connector on the front side.

In this case, the chuck is moved forward in the axial direction by an inertia force of the weight body by swinging the body cylinder back and forth, and thus, it is possible to promptly release the writing lead without performing the clicking operation.

Preferably, the above-described mechanical pencil, further includes a ferrule which is arranged in a tip end region of the lead releasing unit and capable of relatively moving in the axial direction of the body cylinder with respect to the lead releasing unit, and the lead releasing unit includes a lead releasing unit body whose front end portion is surrounded by the ferrule, and a holding member which is configured to hold the ferrule in the lead releasing unit body in a retained state.

In this case, the ferrule does not undesirably fall out of the lead releasing unit at the time of assembling or disassembling of the mechanical pencil, and thus, workability is favorable.

Preferably, the holding member is tubular and has a diameter-reduced portion on an inner surface thereof, and the ferrule has a diameter-enlarged portion that is larger in diameter than an inner diameter of the diameter-reduced portion on an outer surface of the body cylinder on the rear side in the axial direction than the diameter-reduced portion. In this case, it is possible to reliably prevent the ferrule from falling out of the lead releasing unit.

More preferably, the pressed portion is provided in the holding member. In this case, it is easy to provide the pressed portion (tapered surface) at a desired position.

In addition, preferably, the ferrule includes a tubular front region, which protrudes outwardly from a front end of the body cylinder and surrounds the writing lead released from the lead releasing unit, and a shoulder portion which is provided in the front region on the rear side in the axial direction of the body cylinder and widened outwardly in a radial direction of the body cylinder, the body cylinder has an inner brim which overhangs inwardly in the radial direction of the body cylinder on the front side in the axial direction of the body cylinder than the shoulder portion, and the shoulder portion and the inner brim are in point-contact or line-contact with each other.

In this case, it is possible to extremely decrease the contact area between the inner brim of the body cylinder and the shoulder portion of the ferrule, and the ferrule can smoothly move with respect to the body cylinder. Accordingly, it is possible to provide a smooth feel when the lead releasing unit including the writing lead relatively moves to the rear side in the axial direction with respect to the body cylinder.

Specifically, the ferrule includes the tubular front region, which protrudes outwardly from the front end of the body cylinder and surrounds the writing lead released from the lead releasing unit, and the shoulder portion which is provided in the front region on the rear side in the axial direction of the body cylinder and widened outwardly in a radial direction of the body cylinder, the body cylinder has the inner brim which overhangs inwardly in the radial direction of the body cylinder on the front side in the axial direction of the body cylinder than the shoulder portion, the shoulder portion is a second tapered surface which increases in diameter toward the rear side in the axial direction of the body cylinder, and the inner brim and the second tapered surface abut on each other.

In this case, preferably, the second tapered surface has an angle of 5° or larger and 20° or smaller with respect to a plane orthogonal to the axial direction of the body cylinder. In this case, the ferrule can move particularly smoothly with respect to the body cylinder while providing a favorable writing feeling. That is, frictional resistance between the inner brim of the body cylinder and the shoulder portion of the ferrule is small if this angle is 5° or larger, and the smooth movement of the ferrule in the radial direction of the body cylinder is realized. On the other hand, if this angle is smaller than 20°, the ferrule does not greatly move to the rear side in the axial direction when the lead releasing unit including the writing lead relatively moves to the rear side in the axial direction with respect to the body cylinder so that it is possible to avoid deterioration in writing feeling.

Alternatively, the inner brim may include a protrusion protruding toward the rear side in the axial direction of the body cylinder and abutting on the shoulder portion, and the protrusion and the shoulder portion may abut on each other.

Even in this case, it is possible to extremely decrease the contact area between the inner brim and the shoulder portion, and the ferrule can smoothly move with respect to the body cylinder. Accordingly, it is possible to provide a smooth feel when the lead releasing unit including the writing lead relatively moves to the rear side in the axial direction with respect to the body cylinder.

Alternatively, the inner brim may have a third tapered surface, which increases in diameter toward the front side in the axial direction of the body cylinder, in a region facing the shoulder portion.

In this case, a protrusion that protrudes toward the shoulder portion of the ferrule is formed in a radially inward region of the body cylinder due to the presence of the third tapered surface. Thus, it is possible to extremely decrease the contact area between the inner brim and the shoulder portion, and the ferrule can smoothly move with respect to the body cylinder. Accordingly, it is possible to provide a smooth feel when the lead releasing unit including the writing lead relatively moves to the rear side in the axial direction with respect to the body cylinder.

DESCRIPTION OF EMBODIMENTS

Hereinafter, a first embodiment of the present invention will be described in detail with reference to the accompanying drawings.

Figure 1:
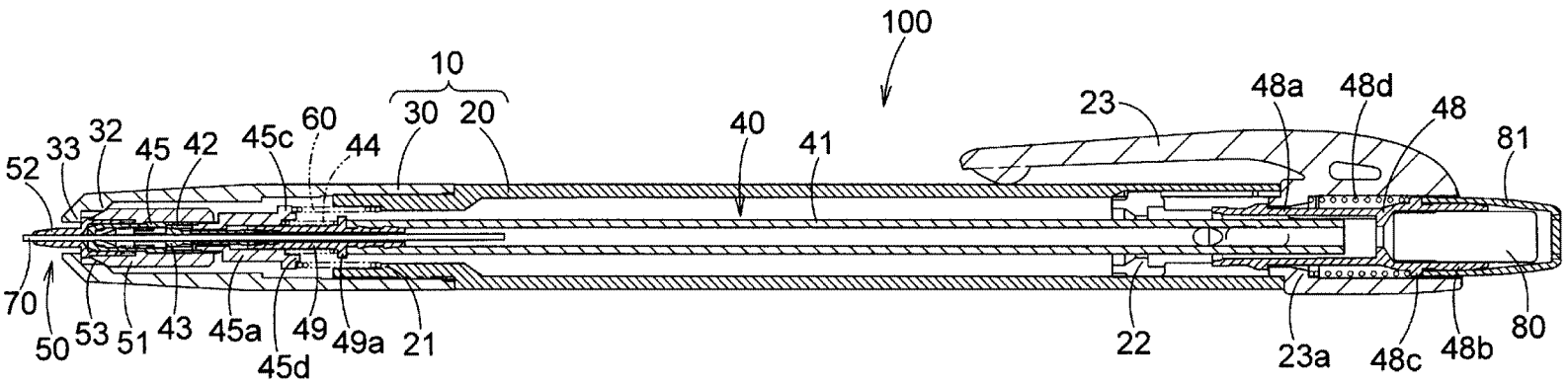
FIG. 1 is a schematic vertical cross-sectional view of a mechanical pencil according to a first embodiment of the present invention.
Figure 2:
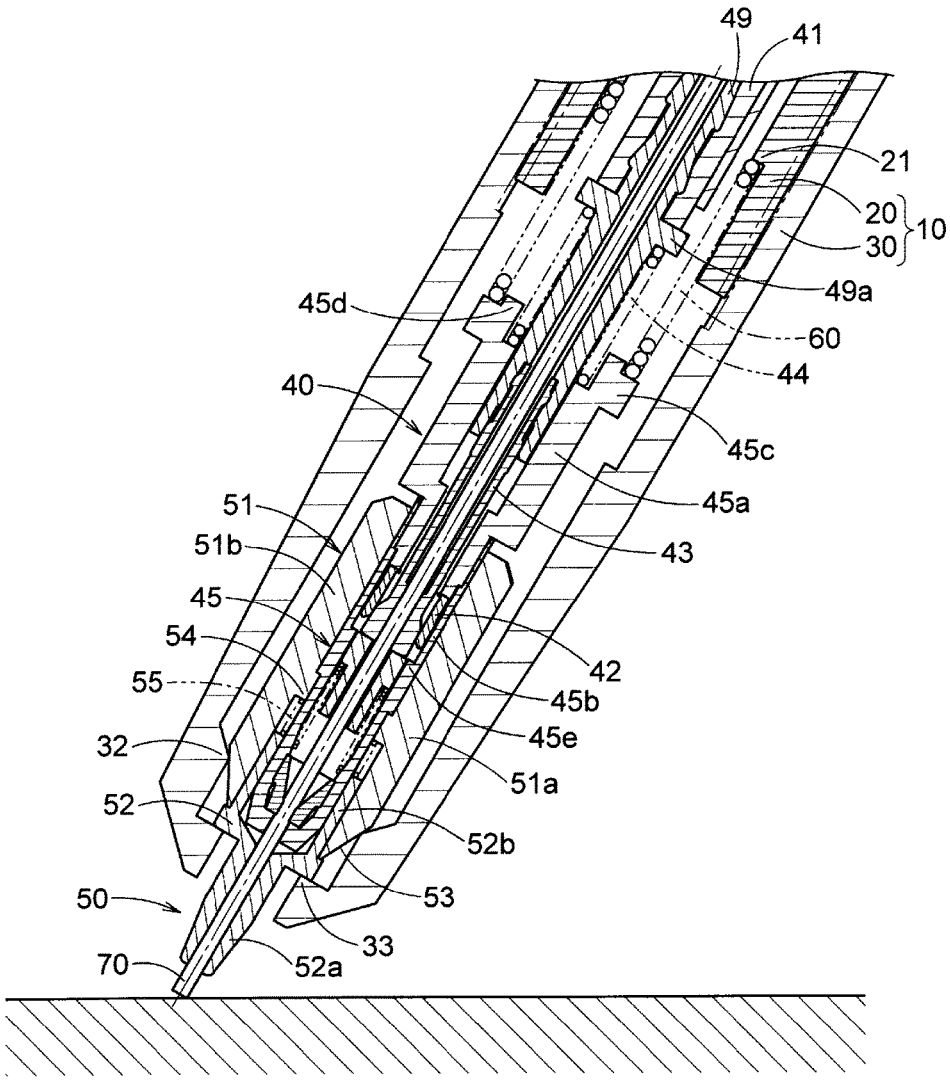
FIG. 2 is a schematic vertical cross-sectional view of a front region of the mechanical pencil of FIG. 1 when writing pressure is not applied to a writing lead.
Figure 3:
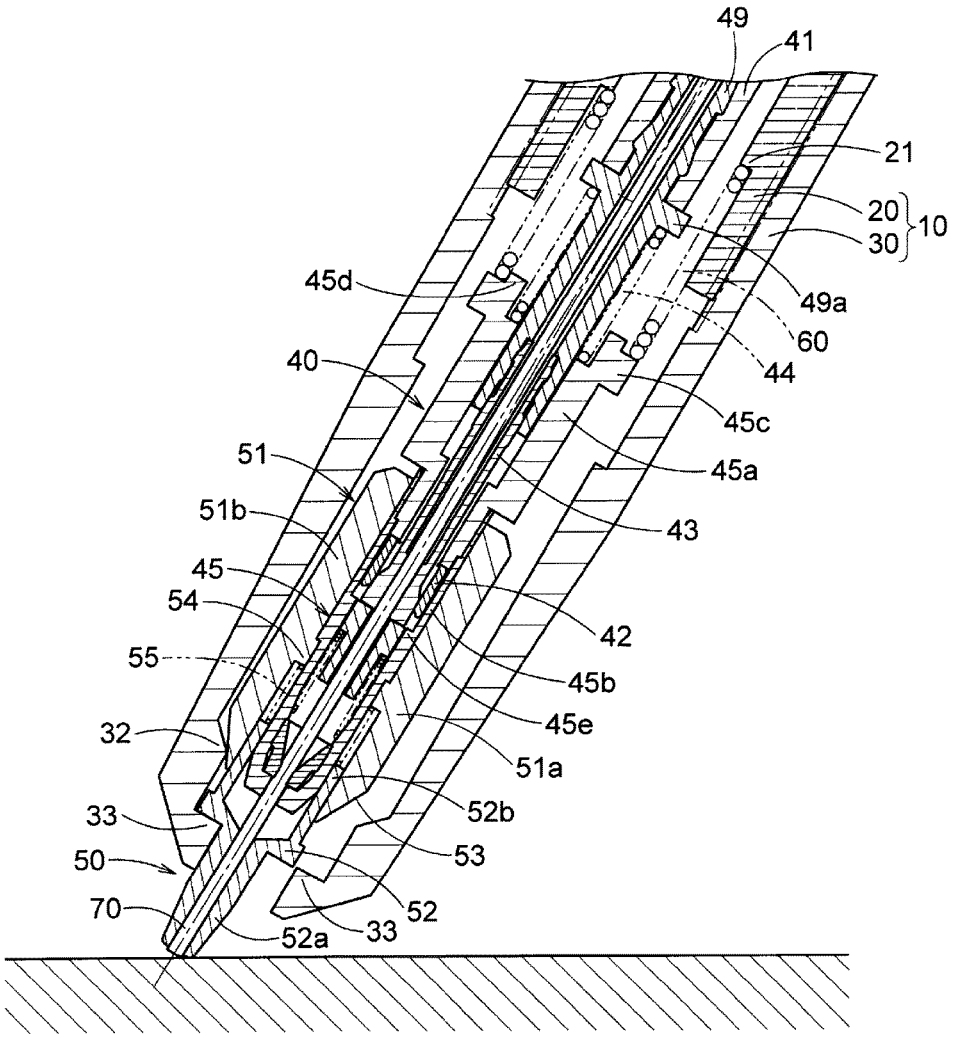
FIG. 3 is a schematic vertical cross-sectional view of the front region of the mechanical pencil of FIG. 1 when writing pressure is applied to the writing lead.

FIG. 1 is a schematic vertical cross-sectional view of a mechanical pencil 100 according to the first embodiment of the present invention, FIG. 2 is a schematic vertical cross-sectional view of a front region of the mechanical pencil 100 of FIG. 1 when writing pressure is not applied to a writing lead 70, and FIG. 3 is a schematic vertical cross-sectional view of the front region of the mechanical pencil 100 of FIG. 1 when writing pressure is applied to the writing lead 70.

The mechanical pencil 100 of the present embodiment includes a body cylinder 10, and a lead releasing unit 40 of which front region is capable of tilting inside the body cylinder 10, and which is supported inside the body cylinder 10 and configured to release the writing lead 70 as illustrated in FIGS. 1 to 3. The body cylinder 10 of the present embodiment is made of polycarbonate and is constituted by a rear shaft 20 and a front shaft 30 whose rear region is fixed (screwed) to a front region of the rear shaft 20.

The lead releasing unit 40 of the present embodiment includes a lead pipe 41 made of polypropylene and extending in the axial direction of the body cylinder 10 inside the body cylinder 10, a chuck 43 made of brass and fixed to a front end portion of the lead pipe 41 via a connector 49, a fastening ring 42 made of brass and externally fitted to a front region of the chuck 43, an outer cylinder 45 surrounding the chuck 43, and a return spring 44 that biases the lead pipe 41 to the rear side in the axial direction with respect to the outer cylinder 45.

Specifically, the outer cylinder 45 includes a rear cylinder 45*a*, which supports the chuck 43 on an inner circumferential surface of a front region and has a flange portion 45*c* as an overhanging portion on an outer circumferential surface of a rear region, and a front cylinder 45*b*, which is externally fitted and fixed to a front end region of the rear cylinder 45*a* and extends to the front side in the axial direction over a front end portion of the chuck 43, as illustrated in FIGS. 2 and 3. In addition, the flange portion 45*c* has a cylindrical wall 45*d*, which extends to the rear side in the axial direction with a gap between the flange portion 45*c* and an outer circumferential surface of the connector 49, at a rear end portion thereof. The return spring 44 is arranged in a compressed state between the flange portion 45*c* and the protrusion 49*a* of the connector 49 in the gap between the cylindrical wall 45*d* and the connector 49, and biases the lead pipe 41 to the rear side in the axial direction with respect to the outer cylinder 45. In this state, the chuck 43 is fastened by the fastening ring 42 so as to nip the writing lead 70 so as not to retract. Further, the front cylinder 45*b* has an abutment step portion 45*e*, which restricts forward movement of the fastening ring 42 in the middle of the movement, on an inner circumferential surface on the front side in the axial direction of the fastening ring 42.

In addition, the body cylinder 10 (the rear shaft 20) has a protruding portion 21 on the inner circumferential surface on the rear side in the axial direction of the flange portion 45*c* of the outer cylinder 45, and a stretchable coil spring 60 is arranged in a compressed state between the protruding portion 21 and the flange portion 45*c* as illustrated in FIG. 1. With such a configuration, the lead releasing unit 40 including the writing lead 70 can relatively move to the rear side in the axial direction with respect to the body cylinder 10 against the biasing force of the coil spring 60.

In addition, an inner diameter of the rear region of the front shaft 30 is larger than an outer diameter of the flange portion 45*c*, and a gap is formed between an inner circumferential surface of the front shaft 30 and the outer circumferential surface of the flange portion 45*c*. Accordingly, the tilting of the lead releasing unit 40 with respect to the body cylinder 10 is allowed.

In addition, a ferrule 52 made of brass is attached to a tip end region of the lead releasing unit 40. The ferrule 52 of the present embodiment is supported by a tubular base member 51, made of brass and fixed to a front end region of the lead releasing unit 40, so as to be relatively movable in the axial direction, and forms a ferrule unit 50 together with the base member 51.

The base member 51 has a pressed portion 53 at a front end portion thereof. The pressed portion 53 of the present embodiment is configured as a tapered surface having an angle of 25° with respect to the axial direction of the body cylinder 10. In addition, the body cylinder 10 (the front shaft 30) has a pressing portion 32, which overhangs to the inner circumferential surface, in the front region thereof. In the present embodiment, the pressing portion 32 and the pressed portion 53 abut on each other before the lead releasing unit 40 tilts as illustrated in FIG. 2. Then, it is configured such that the pressing portion 32 relatively moves the pressed portion 53 to rear side in the axial direction with respect to the body cylinder 10 when the lead releasing unit 40 tilts as illustrated in FIG. 3. In the present embodiment, a spring constant of the coil spring 60 is 800 N/m, and a load necessary to relatively move the pressed portion 53 (tapered surface) to the rear side in the axial direction with respect to the body cylinder 10 against the biasing force of the coil spring 60 is 3.4 N.

In addition, the base member 51 has an inner diameter of a rear region 51*b* that is smaller than an inner diameter of a front region 51*a*, and a step portion 54 is formed on an inner circumferential surface of a connection part between the front region 51*a* and the rear region 51*b* in the present embodiment, as illustrated in FIGS. 1 to 3. A cylindrical gap is formed between an inner circumferential surface of the front region 51*a* and the outer circumferential surface of the lead releasing unit 40, and the ferrule 52 is inserted into this gap.

Specifically, the ferrule 52 is constituted by the pipe-shaped front region 52*a* which guides the writing lead 70 and the sleeve-shaped rear region 52*b* whose diameter is larger than that of the front region 52*a*, and the rear region 52*b* is inserted into the cylindrical gap as illustrated in FIGS. 2 and 3. Further, the body cylinder 10 (front shaft 30) has an inner brim 33 on the inner circumferential surface on the front side in the axial direction than the front end portion of the rear region 52*b* of the ferrule 52, and an inner diameter of the body cylinder 10 (front shaft 30) is smaller than an outer diameter of the rear region 52*b* of the ferrule 52 in the inner brim 33. That is, as the inner brim 33 and the rear region 52*b* of the ferrule 52 abut on each other, the relative movement of the ferrule 52 to the rear side in the axial direction with respect to the body cylinder 10 is restricted, and the falling-out of the lead releasing unit 40 is prevented. In this state, a stretchable spring 55 is arranged in a compressed state between a rear end portion of the rear region 52*b* of the ferrule 52 and the step portion 54 of the base member 51. With such a configuration, the abutment state between the ferrule 52 and the inner brim 33 of the body cylinder 10 is maintained even when the lead releasing unit 40 is relatively moved to the rear side in the axial direction with respect to the body cylinder 10. In this manner, it is configured such that a length of the writing lead 70 exposed from the front end portion of the ferrule 52 is decreased when the lead releasing unit 40 including the writing lead 70 is relatively moved to the rear side in the axial direction with respect to the body cylinder 10.

In addition, the lead releasing unit 40 further includes a click portion 48, which is attached to a rear end of the lead pipe 41 and configured to press the lead pipe 41 to the front side in the axial direction with respect to the outer cylinder 45, as illustrated in FIG. 1. The click portion 48 of the present embodiment has a sleeve portion 48*a*, which is fitted to a rear end region of the lead pipe 41, on the front side in the axial direction and a holder portion 48*b* that detachably holds a columnar eraser 80 on the rear side in the axial direction. An internal space of the sleeve portion 48*a* and an internal space of the holder portion 48*b* communicate with each other through an opening. Accordingly, it is configured such that the writing lead 70 can be input into the lead pipe 41 from the opening as the eraser 80 is removed from the holder portion 48*b*. In addition, a dome-shaped knob 81, which covers a rear side of the eraser 80, is externally fitted to the holder portion 48*b* in a removable manner.

Further, a head cap 23 is fixed to a rear end region of the rear shaft 20 in the present embodiment. A step portion 23*a* facing to the rear side in the axial direction is formed on an inner circumferential surface of the cap 23. In addition, a flange portion 48*c* is formed on an outer circumference of the holder portion 48*b*, and a stretchable spring 48*d* is arranged in a compressed state between the flange portion 48*c* and the step portion 23*a*.

Next, an operation of the mechanical pencil 100 according to the first embodiment of the present invention will be described.

First, the knob 81 and the eraser 80 are removed from the holder portion 48*b* if necessary prior to writing on a paper surface, and the writing lead 70 is input into the lead pipe 41 via the opening which causes the sleeve portion 48*a* and the holder portion 48*b* to communicate with each other. Then, the eraser 80 and the knob 81 are attached to the holder portion 48*b*, the click portion 48 (the knob 81) is pressed (clicked) to the front side in the axial direction in a state where the front end of the ferrule 52 is directed downward. Accordingly, the lead pipe 41, the connector 49, the chuck 43, and the fastening ring 42 are moved forward against a biasing force of the return spring 44. Only the fastening ring 42 abuts on the abutment step portion 45*e*, formed on the front cylinder 45*b* of the outer cylinder 45, in the middle of this forward movement. Accordingly, the fastening ring 42 gets out rearward from the chuck 43, and the chuck 43 is opened, and the writing lead 70 is released. At the time of press (click), an appropriate sense of resistance is brought about by a biasing force of the spring 48*d* arranged between the flange portion 48*c* of the click portion 48 and the step portion 23*a* of the head cap 23.

Then, when the pressed state of the click portion 48 (the knob 81) is released, the lead pipe 41 is retracted together with the chuck 43 by the biasing force of the return spring 44. Along with this, the fastening ring 42 is externally fitted to the front region of the chuck 43 again, and the chuck 43 is fastened. Accordingly, the writing lead 70 is nipped so as not to retract, and the state where the writing lead 70 is released is maintained. Then, the writing lead 70 is exposed (released) from the tip end of the ferrule 52 by a desired length as this series of pressing operations is appropriately repeated (see FIG. 2). Then, writing is performed as a user grasps the front shaft 30 and the moves body cylinder 10 as desired while causing the writing lead 70 to abut on the paper surface.

At the time of writing, the body cylinder 10 is generally grasped such that the axial direction thereof forms an acute angle with the paper surface (see FIGS. 2 and 3). Thus, writing pressure containing a component vertical to the axial direction of the body cylinder 10 and a component in the axial direction is applied to the writing lead 70. The mechanical pencil 100 of the present embodiment absorbs each of the component vertical to the axial direction and the component in the axial direction of the writing pressure when high writing pressure is applied to the writing lead 70 at the time of writing, thereby avoiding breakage of the writing lead 70 exposed from the tip end of the ferrule 52.

Specifically, the front region of the lead releasing unit 40 is tilted by the component vertical to the axial direction of the writing pressure, and the pressed portion 53 (tapered surface) of the base member 51 is pressed to the rear side in the axial direction by the pressing portion 32 of the front shaft 30 as illustrated in FIG. 3. Accordingly, the lead releasing unit 40 including the writing lead 70 and the base member 51 is relatively moved to the rear side in the axial direction with respect to the body cylinder 10 against the biasing force of the coil spring 60. On the other hand, the ferrule 52 is pressed to the front side in the axial direction with respect to the base member 51 by the biasing force of the spring 55, and thus, is not relatively moved to the rear side in the axial direction with respect to the body cylinder 10. As a result, the length of the writing lead 70 exposed from the tip end of the ferrule 52 is decreased.

At the same time, the writing lead 70 is pressed to the rear side in the axial direction with respect to the body cylinder 10 by the component in the axial direction of the writing pressure as illustrated in FIG. 3. Accordingly, the lead releasing unit 40 including the writing lead 70 and the base member 51 is further relatively moved to the rear side in the axial direction against the biasing force of the coil spring 60. That is, the length of the writing lead 70 exposed from the tip end of the ferrule 52 is further decreased, and the breakage of the writing lead 70 is avoided.

Then, when the writing pressure applied to the writing lead 70 is weakened, the lead releasing unit 40 including the writing lead 70 and the base member 51 is pushed back to the front side in the axial direction by the biasing force of the coil spring 60. Accordingly, the initial state (see FIG. 2) is restored.

According to the present invention as above, when the high writing pressure is applied to the writing lead 70, the front region of the lead releasing unit 40 is tilted inside the body cylinder 10 due to the component vertical to the axial direction of the writing pressure. In this manner, the lead releasing unit 40 including the writing lead 70 is relatively moved to the rear side in the axial direction with respect to the body cylinder 10 against the biasing force of the coil spring 60, and thus, the length of the writing lead 70 exposed from the tip end of the ferrule 52 is decreased. Further, the lead releasing unit 40 including the writing lead 70 is further relatively moved to the rear side in the axial direction with respect to the body cylinder 10 against the biasing force of the coil spring 60 due to the component in the axial direction of the writing pressure so that the length of the writing lead 70 exposed from the tip end of the ferrule 52 is further decreased. As a result, the breakage of the writing lead 70 can be reliably avoided when the high writing pressure is applied to the writing lead 70. In addition, at this time, the ferrule 52 is not relatively moved (pops out) to the front side in the axial direction with respect to the body cylinder 10, but the lead releasing unit 40 including the writing lead 70 is relatively moved to the rear side in the axial direction with respect to the ferrule 52 so that the length of the writing lead 70 exposed from the ferrule 52 is decreased. Thus, when the tip end of the ferrule 52 and the paper surface abut on each other, the length of the writing lead 70 exposed from the ferrule 52 is rapidly increased by the biasing force of the coil spring 60 only by slightly weakening the writing pressure, and thus, it is possible to rapidly eliminate the contact between the tip end of the ferrule 52 and the paper surface.

In addition, the pressed portion 53 of the lead releasing unit 40 is the tapered surface, the tapered surface has the angle of 25° with respect to the axial direction of the body cylinder 10, and the spring constant of the coil spring 60 is 800 N/m. With such a combination of the pressed portion 53 and the coil spring 60, the load necessary to relatively move the pressed portion 53 (tapered surface) to the rear side in the axial direction with respect to the body cylinder 10 against the biasing force of the coil spring 60 is 3.4 N. As a result, when the high writing pressure is applied to the writing lead 70, the lead releasing unit 40 including the writing lead 70 is relatively moved to the rear side in the axial direction with respect to the body cylinder 10 reliably, and thus, the breakage of the writing lead 70 is reliably avoided. On the other hand, when appropriate writing pressure is applied to the writing lead 70, the lead releasing unit 40 including the writing lead 70 is not relatively moved substantially to the rear side in the axial direction with respect to the body cylinder 10, and thus, there is no loss of writing feeling.

Incidentally, the lead releasing unit 40 does not necessarily tilt, but the lead releasing unit 40 may be configured to be flexurally deformed. Even in this case, it is possible to cause the lead releasing unit 40 to be relatively moved to the rear side in the axial direction with respect to the body cylinder 10 due to the writing pressure vertical to the axial direction of the body cylinder 10. This flexural deformation can be realized, for example, by forming the lead pipe 41 using a flexible material.

In addition, the base member 51 is provided with the tapered surface which gradually increases in diameter toward the rear side in the axial direction as the pressed portion 53 in the present embodiment, but this tapered surface may be provided as a pressing portion 32 in the front region of the front shaft 30. In this case, the pressed portion 53 of the base member 51 may be formed as an overhanging portion overhanging outwardly in the radial direction of the body cylinder 10, or may be formed as the tapered surface which gradually increases in diameter toward the rear side in the axial direction as in the present embodiment.

In addition, a click type is adopted as the lead releasing unit 40 in the present embodiment, but a swing-type lead releasing unit from which the writing lead 70 is released by swinging the body cylinder 10 back and forth may be adopted.

In this case, the connector 49 with the protrusion 49*a*, which protrudes outwardly in the radial direction of the body cylinder 10 over the outer diameter of the lead pipe 41, may adopted, and further, a weight body may be loosely fitted to the outer circumference of the lead pipe 41 in a space portion formed between the body cylinder 10 and the lead pipe 41. For example, a weight body having a weight of 2.3 g and formed by winding a wire around the axis of the body cylinder 10 in a cylindrical shape can be adopted as the weight body. In this case, the weight body moves back and forth inside the space portion and abuts against the protrusion 49*a* of the connector 49 on the front side in the axial direction when the body cylinder 10 is swung back and forth. Then, the connector 49 is moved forward in the axial direction by an inertia force of the weight body at the time of abutment, whereby the writing lead 70 is released.

Even if such a swing-type lead releasing unit is adopted, it is possible to obtain the same effect as that of the case of adopting the click-type lead releasing unit 40. Further, it is possible to promptly release the writing lead 70 without performing the clicking operation.

Next, a mechanical pencil 200 according to a second embodiment of the present invention will be described with reference to FIGS. 4 and 5.

Figure 4:
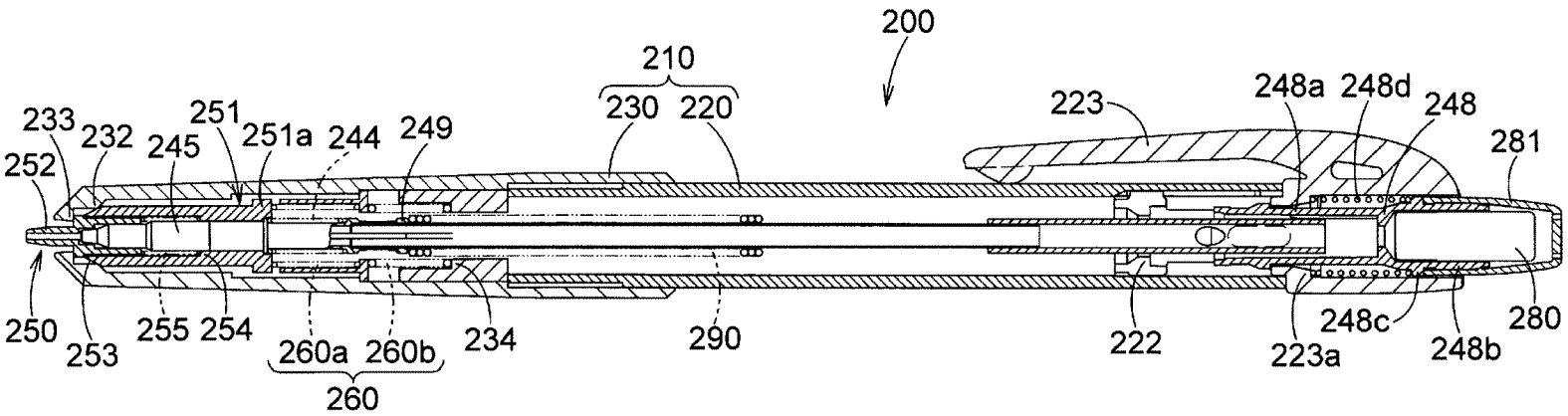
FIG. 4 is a schematic vertical cross-sectional view of a mechanical pencil according to a second embodiment of the present invention.
Figure 5:
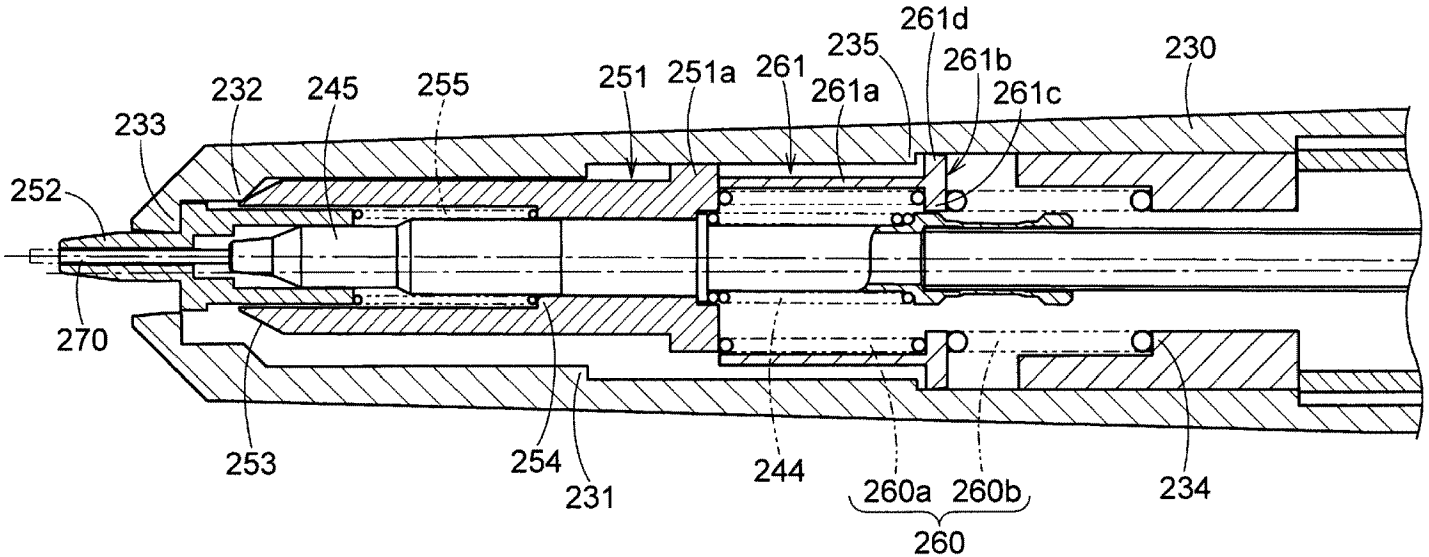
FIG. 5 is a schematic vertical cross-sectional view of a front region of the mechanical pencil of FIG. 4 when writing pressure is applied to a writing lead.

FIG. 4 is a schematic vertical cross-sectional view of the mechanical pencil 200 according to the second embodiment of the present invention, and FIG. 5 is a schematic vertical cross-sectional view of a front region of the mechanical pencil 200 of FIG. 4 when writing pressure is applied to a writing lead 270. As illustrated in FIGS. 4 and 5, a flange portion 251*a* is provided on an outer circumferential surface of a rear region of a base member 251, instead of the outer circumferential surface of the rear region of the outer cylinder 45, in the mechanical pencil 200 of the present embodiment, which is different from the first embodiment. In addition, a protruding portion 234 abutting on a rear end portion of a coil spring 260 is provided on an inner circumferential surface of a front shaft 230, instead of a rear shaft 220, on the rear side in the axial direction of the flange portion 251*a*. Further, a weak coil spring 260*a* and a strong coil spring 260*b*, which is arranged on the rear side of the weak coil spring 260*a* in the axial direction, connected in series are adopted as the stretchable coil spring 260 arranged in a compressed state between the protruding portion 234 of the front shaft 230 and the flange portion 251*a*. In the present embodiment, a spring constant of the weak coil spring 260*a* is 700 N/m, and a spring constant of the strong coil spring 260*b* is 1000 N/m.

The weak coil spring 260*a* and the strong coil spring 260*b* are connected via a cylindrical regulating member 261 that regulates a compressed length of the weak coil spring 260*a*. This regulating member 261 includes a sleeve portion 261*a* that covers the outside of the weak coil spring 260*a* and an annular portion 261*b* that is formed integrally with a rear end portion of the sleeve portion 261*a*. Further, the annular portion 261*b* includes an inner protruding portion 261*c* that protrudes to the more inner side in the radial direction of a body cylinder 210 than an inner wall of the sleeve portion 261*a*, and an outer protruding portion 261*d* that protrudes to the more outer side in the radial direction of the body cylinder 210 than an outer wall of the sleeve portion 261*a*. In the present embodiment, a gap is formed between an inner circumferential surface of the inner protruding portion 261*c* and an outer circumferential surface of the lead releasing unit 240 such that interference of the lead releasing unit 240 and the regulating member 261 is avoided when the lead releasing unit 240 tilts. Further, the weak coil spring 260*a* is arranged in a compressed state between the flange portion 251*a* and the inner protruding portion 261*c* so as to be stretchable, and the strong coil spring 260*b* is arranged in a compressed state between the inner protruding portion 261*c* and the protruding portion 234 so as to be stretchable.

In addition, a step portion 235 facing to the rear side in the axial direction is formed on the front side in the axial direction of the protruding portion 234 of the front shaft 230, and the annular portion 261*b* of the regulating member 261 is internally fitted to the rear side in the axial direction of the step portion 235 so as to be slidable in the axial direction. In addition, an inner diameter of the body cylinder 210 (front shaft 230) is smaller than an outer diameter of the outer protruding portion 261*d* on the front side in the axial direction of the step portion 235, and the annular portion 261*b* is configured so as not to slide to the front side in the axial direction over the step portion 235. In the present embodiment, the annular portion 261*b* of the regulating member 261 abuts on the step portion 235 by a biasing force of the strong coil spring 260*b* when writing pressure is not applied to the writing lead 270. In this state, a gap, for example, of 0.8 mm is formed between a front end portion of the sleeve portion 261*a* of the regulating member 261 and a rear end portion of the flange portion 251*a*.

With the above configuration, a load necessary to relatively move the pressed portion 253 (tapered surface) to the rear side in the axial direction with respect to the body cylinder 210 against a biasing force of the weak coil spring 260*a* is 2.5 N, and a load necessary to relatively move the pressed portion 253 (tapered surface) to the rear side in the axial direction with respect to the body cylinder 210 against the biasing force of the strong coil spring 260*b* is 7 N in the present embodiment.

In addition, the rear shaft 220 of the present embodiment has a protruding portion 222 on an inner circumferential surface of a rear region thereof, and a weight body 290 is arranged between the protruding portion 222 and the connector 249 as illustrated in FIG. 4. A weight body having a weight of 2.3 g and formed by winding a wire around the axis of the body cylinder 210 in a cylindrical shape can be adopted as the weight body 290. An inner diameter of the rear shaft 220 is smaller than an outer diameter of the weight body 290 in the protruding portion 222. In addition, the connector 249 has a protrusion on an outer circumferential surface thereof.

Other configurations are the same as those of the mechanical pencil 100 of the first embodiment. The same components as those of the first embodiment are denoted by substantially the same reference numerals in FIGS. 4 and 5, and a detailed description thereof will be omitted.

Next, an operation of the mechanical pencil 200 of the present embodiment will be described.

In the mechanical pencil 200 of the present embodiment, the weight body 290 moves back and forth inside a space portion formed between the body cylinder 210 and the lead pipe 241 until abutting on the protrusion of the connector 249 on the front side in the axial direction and until abutting on the protruding portion 222 on the rear side in the axial direction as the body cylinder 210 is swung back and forth. Then, when the weight body 290 moves forward, the connector 249, a chuck, and a fastening ring are caused to move forward by an inertia force of the weight body 290 against a biasing force of the return spring 244. In the middle of this forward movement, only the fastening ring abuts on an abutment step portion formed on an inner circumferential surface of the outer cylinder 245. Accordingly, the fastening ring gets out to the rear side in the axial direction from the chuck, and the chuck is opened, and the writing lead 270 is released.

Then, when the influence of the inertia force of the weight body 290 on the connector 249 disappears, the connector 249 is retracted by the biasing force of the return spring 244. Along with this, the chuck engaged with the connector 249 is also retracted, the fastening ring is externally fitted to a front region of the chuck again, and the chuck is fastened. Accordingly, the writing lead 270 is nipped so as not to retract, and the state where the writing lead 270 is released is maintained. Then, the writing lead 270 is exposed (released) from a tip end of the ferrule 252 by a desired length as such forward and backward movement of the body cylinder 210 is appropriately repeated.

In the mechanical pencil 200 of the present embodiment, the writing lead 270 is released even when a click portion 248 is pressed (clicked), which is similar to the first embodiment. At the time of press (click), an appropriate sense of resistance is brought about by a biasing force of a spring 248*d* arranged between a flange portion 248*c* of the click portion 248 and a step portion 223*a* of a head cap 223.

Then, writing is performed as a user grasps the front shaft 230 and moves the body cylinder 210 as desired while causing the writing lead 270 to abut on the paper surface.

At the time of writing, generally, writing pressure containing a component vertical to the axial direction of the body cylinder 210 and a component in the axial direction is applied to the writing lead 270 as described above. The mechanical pencil 200 of the present embodiment also absorbs each of the component vertical to the axial direction and the component in the axial direction of the writing pressure when high writing pressure is applied to the writing lead 270 at the time of writing, thereby avoiding breakage of the writing lead 270 exposed from the tip end of the ferrule 252, which is similar to the first embodiment.

Specifically, the front region of the lead releasing unit 240 is tilted by the component vertical to the axial direction of the writing pressure, and the pressed portion 253 (tapered surface) of the base member 251 is pressed to the rear side in the axial direction by the pressing portion 232 of the front shaft 230 as illustrated in FIG. 5. Accordingly, the lead releasing unit 240 including the writing lead 270 is relatively moved to the rear side in the axial direction with respect to the body cylinder 210 against the biasing forces of the weak coil spring 260*a* and the strong coil spring 260*b*.

At this time, the weak coil spring 260*a* is allowed to be compressed and deformed by, for example, 0.8 mm at a maximum due to the presence of the sleeve portion 261*a* of the regulating member 261. Then, when the weak coil spring 260*a* is compressed and deformed by 0.8 mm, the rear end portion of the flange portion 251*a* of the base member 251 abuts on the front end portion of the sleeve portion 261*a*. When the lead releasing unit 240 is further relatively moved to the rear side in the axial direction from this state, the base member 251, the lead releasing unit 240 and the movement regulating member 261 are relatively moved to the rear side in the axial direction against the biasing force of the strong coil spring 260*b* in an integrated manner. During this relative movement, a greater sense of resistance is brought about due to a difference in load necessary to cause further compressive deformation of each of the coil springs 260*a* and 260*b* arranged in the compressed state as compared to the case in which the lead releasing unit 240 is relatively moved to the rear side in the axial direction against the biasing force of the weak coil spring 260*a*. On the other hand, the ferrule 52 is pressed to the front side in the axial direction with respect to the base member 251 by the biasing force of the spring 255, and thus, is not relatively moved to the rear side in the axial direction with respect to the body cylinder 210. As a result, the length of the writing lead 270 exposed from the tip end of the ferrule 252 is decreased.

At the same time, the writing lead 270 is pressed to the rear side in the axial direction with respect to the body cylinder 210 by the component in the axial direction of the writing pressure. Accordingly, the lead releasing unit 240 including the writing lead 270 and the base member 251 is relatively moved to the rear side in the axial direction against the biasing forces of the weak coil spring 260*a* and the strong coil spring 260*b*. Even in this case, the coil springs 260*a* and 260*b* are compressed in the order of the weak coil spring 260*a* and the strong coil spring 260*b* as described above. Accordingly, the length of the writing lead 270 exposed from the tip end of the ferrule 252 is further decreased, and the breakage of the writing lead 270 is avoided.

Figure 6:
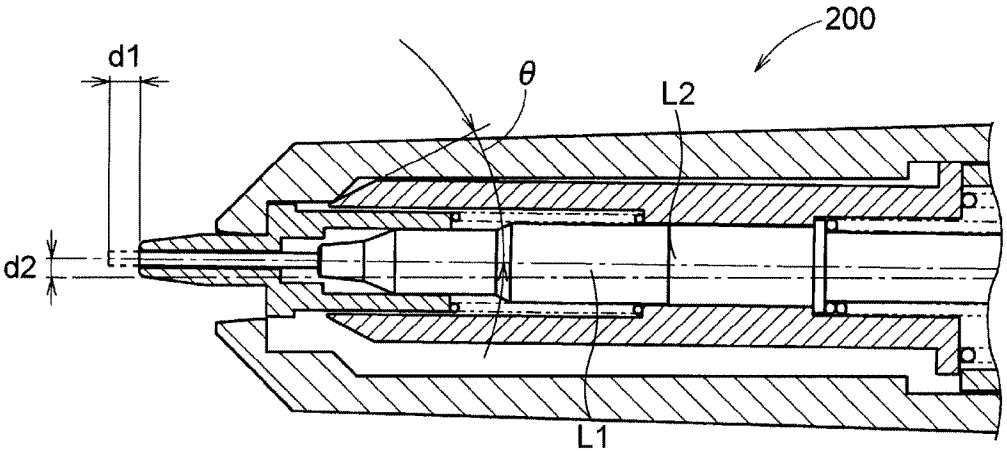
FIG. 6 is a view and a table illustrating examples of a lead pull-in amount and an weighting (working weighting) at which the pull-in of a writing lead starts in a case where an angle of a tapered surface as a pressed portion provided in a lead releasing unit is changed in the mechanical pencil of FIG. 4.

FIG. 6 illustrates examples of a lead pull-in amount (retraction amount of the writing lead 270) in a case where an angle θ of the tapered surface provided as the pressed portion 253 of the base member 251 with respect to the axial direction of the body cylinder 210 is changed in the mechanical pencil 200 of the present embodiment as described above, and a load at which the pull-in (retraction) of the writing lead 270 starts in a case where an angle formed between the axial direction of the body cylinder 210 and the paper surface is 55°. Incidentally, in FIG. 6, L1 is a center line of the body cylinder 210, and L2 is a center line of the writing lead 270 in the state of being released from the lead releasing unit 240. When writing pressure is not applied to the writing lead 270, L1 and L2 are coincide with each other.

Even with the present invention as above, when the high writing pressure is applied to the writing lead 270, the front region of the lead releasing unit 240 is tilted inside the body cylinder 210 due to the component vertical to the axial direction of the writing pressure. In this manner, the lead releasing unit 240 including the writing lead 270 is relatively moved to the rear side in the axial direction with respect to the body cylinder 210 against the biasing force of the coil spring 260, and thus, the length of the writing lead 270 exposed from the tip end of the ferrule 252 is decreased. Further, the lead releasing unit 240 including the writing lead 270 is further relatively moved to the rear side in the axial direction with respect to the body cylinder 210 against the biasing force of the coil spring 260 due to the component in the axial direction of the writing pressure so that the length of the writing lead 270 exposed from the tip end of the ferrule 252 is further decreased. As a result, the breakage of the writing lead 270 can be reliably avoided when the high writing pressure is applied to the writing lead 270. In addition, at this time, the ferrule 252 is not relatively moved (pops out) to the front side in the axial direction with respect to the body cylinder 210, but the lead releasing unit 240 including the writing lead 270 is relatively moved to the rear side in the axial direction with respect to the ferrule 252 so that the length of the writing lead 270 exposed from the ferrule 252 is decreased. Thus, when the tip end of the ferrule 252 and the paper surface abut on each other, the length of the writing lead 270 exposed from the ferrule 252 is rapidly increased by the biasing force of the coil spring 260 only by slightly weakening the writing pressure, and thus, it is possible to rapidly eliminate the contact between the tip end of the ferrule 252 and the paper surface.

In addition, the coil spring 260 of the present embodiment is configured by arranging the weak coil spring 260*a* having the spring constant of 700 N/m and the strong coil spring 260*b* having the spring constant of 1000 N/m in series. Further, the load necessary to relatively move the pressed portion 253 (tapered surface) to the rear side in the axial direction with respect to the body cylinder 210 against a biasing force of the weak coil spring 260*a* is 2.5 N, and the load necessary to relatively move the pressed portion 253 (tapered surface) to the rear side in the axial direction with respect to the body cylinder 210 against the biasing force of the strong coil spring 260*b* is 7 N. In this manner, the writing pressure is absorbed by the weak coil spring 260*a* which starts to be compressed and deformed with a relatively small load and the strong coil spring 260*b* which starts to be compressed and deformed with a relatively large load, stepwise in this order, and thus, it is possible to optimize a sense of resistance due to the biasing force of the coil spring 260 when the lead releasing unit 240 including the writing lead 270 is relatively moved to the rear side in the axial direction with respect to the body cylinder.

In addition, the lead releasing unit 240 includes: the lead pipe 241 which extends in the axial direction of the body cylinder 210 inside the body cylinder 210; the connector 249 which is fixed to the front end portion of the lead pipe 240 and has a protrusion formed on an outer circumferential surface thereof; the chuck which is fixed to the front end portion of the connector 249; the fastening ring which is externally fitted to a front region of the chuck; the return spring 244 which biases the connector 249 to the rear side in the axial direction; and the weight body 290 which is provided so as to be loosely fitted to the outer circumference of the lead pipe 241 in a space portion formed between the body cylinder 210 and the lead pipe 241. The weight body 290 is configured to move back and forth inside the space portion when the body cylinder 210 is swung back and forth and to abut on the protrusion of the connector 249 on the front side. Thus, the chuck is moved forward in the axial direction by the inertia force of the weight body 290 by swinging the body cylinder 210 back and forth, and thus, it is possible to promptly release the writing lead 270 without performing the clicking operation.

Incidentally, the lead releasing unit 240 does not necessarily tilt, but the lead releasing unit 240 may be configured to be flexurally deformed. Even in this case, it is possible to cause the lead releasing unit 240 to be relatively moved to the rear side in the axial direction with respect to the body cylinder 210 due to the writing pressure vertical to the axial direction of the body cylinder 210. This flexural deformation can be realized, for example, by forming the lead pipe 241 using a flexible material.

In addition, the base member 251 is provided with the tapered surface which gradually increases in diameter toward the rear side in the axial direction as the pressed portion 253 in the present embodiment, but this tapered surface may be provided as a pressing portion 232 in the front region of the front shaft 230. In this case, the pressed portion 253 of the base member 251 may be formed as an overhanging portion overhanging outwardly in the radial direction of the body cylinder 210, or may be formed as the tapered surface which gradually increases in diameter toward the rear side in the axial direction as in the present embodiment.

Figure 7:
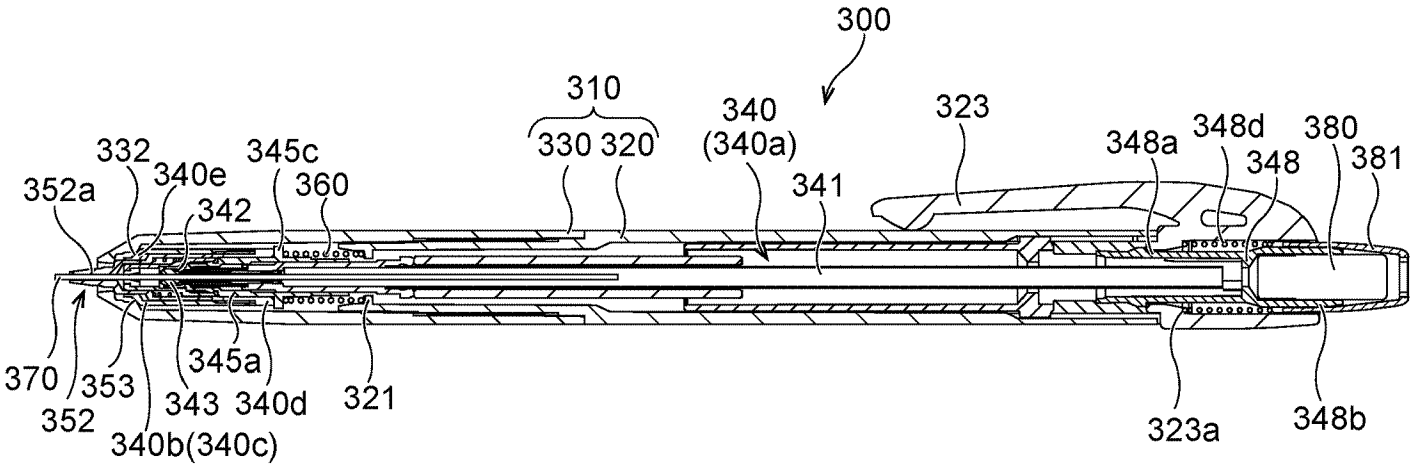
FIG. 7 is a schematic vertical cross-sectional view of a mechanical pencil according to a third embodiment of the present invention.

Next, a mechanical pencil 300 according to a third embodiment of the present invention will be described with reference to FIGS. 7 and 9. FIG. 7 is a schematic vertical cross-sectional view of the mechanical pencil 300 according to the third embodiment of the present invention, FIG. 8 is a schematic vertical cross-sectional view of a front region of the mechanical pencil 300 of FIG. 7 when writing pressure is not applied to a writing lead 370, and FIG. 9 is a schematic vertical cross-sectional view of the front region of the mechanical pencil 300 of FIG. 7 in an exploded view.

Figure 8:
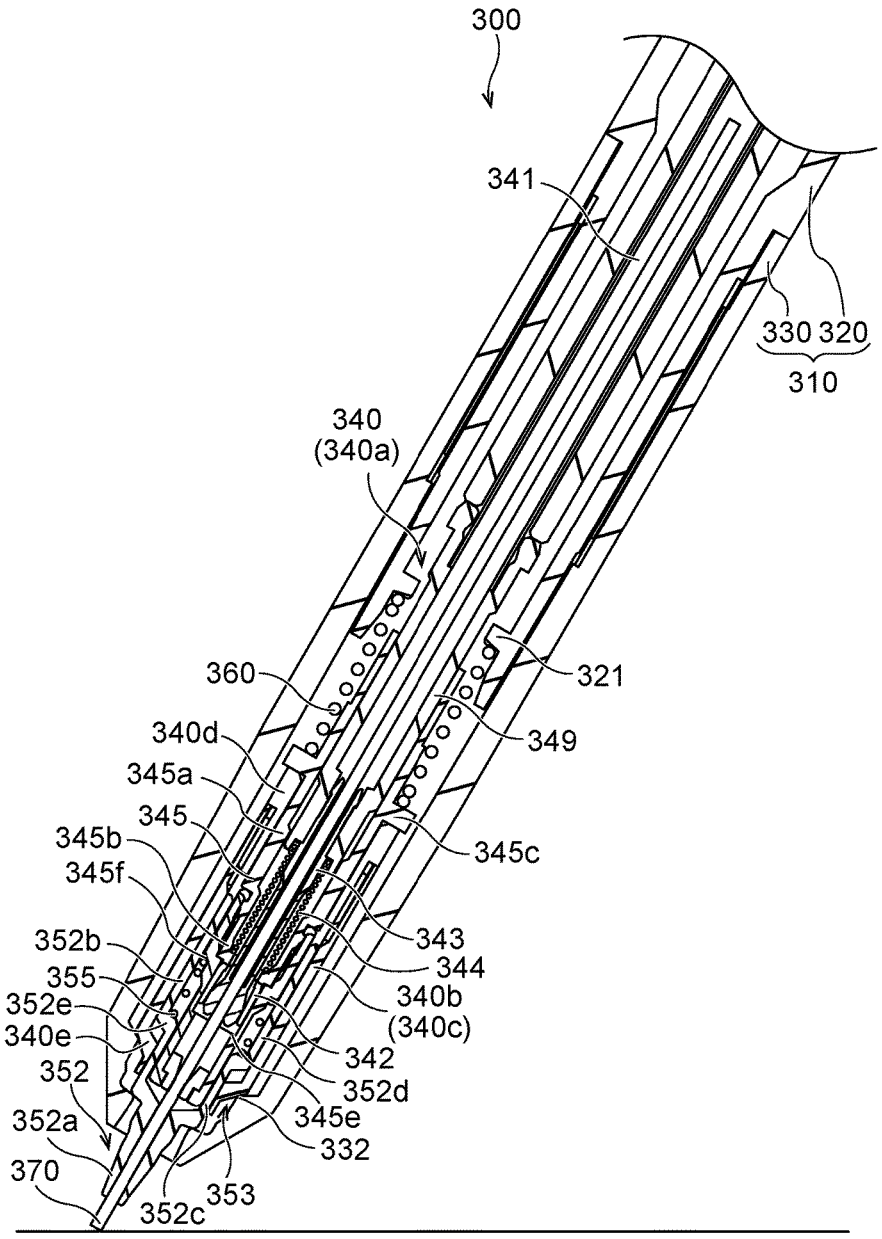
FIG. 8 is a schematic vertical cross-sectional view of a front region of the mechanical pencil of FIG. 7 when writing pressure is applied to a writing lead.
Figure 9:
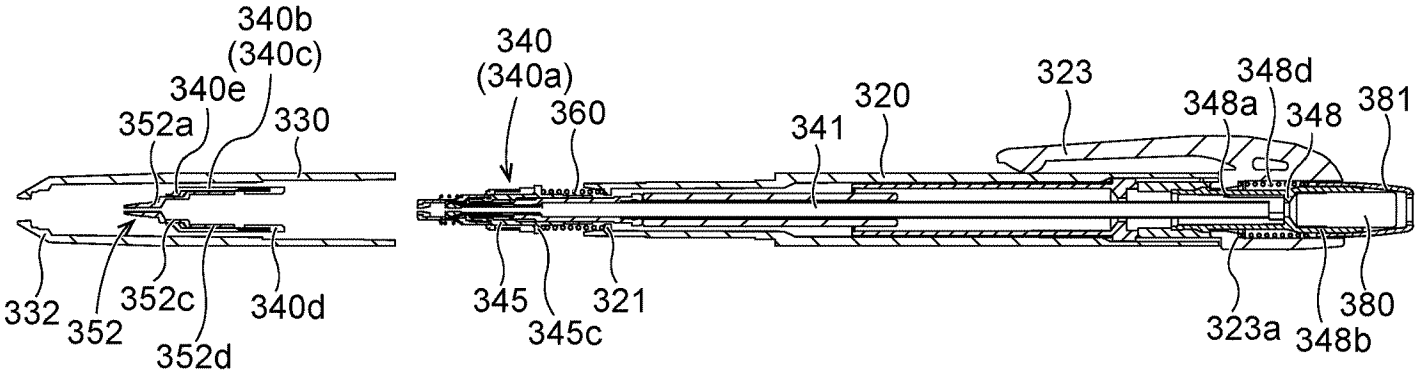
FIG. 9 is a schematic vertical cross-sectional view illustrating the front region of the mechanical pencil of FIG. 7 in an exploded view.

As illustrated in FIGS. 7 to 9, the mechanical pencil 300 of the present embodiment includes a ferrule 352 that is arranged in a tip end region of a lead releasing unit 340 and is relatively movable with respect to the lead releasing unit 340 in the axial direction of a body cylinder 310. The lead releasing unit 340 of the present embodiment includes a lead releasing unit body 340*a* whose front end portion is surrounded by the ferrule 352, and a holding member 340*b* which is configured to hold the ferrule 352 in the lead releasing unit body 340*a* in a retained state. As illustrated in FIG. 8, the ferrule 352 is constituted by a tubular front region 352*a* which guides the writing lead 370 and a sleeve-shaped rear region 352*b* whose diameter is larger than that of the front region 352*a*. The rear region 352*b* has a small diameter portion 352*c* on the front side and a diameter-enlarged portion 352*d* on the rear side, and the small diameter portion 352*c* and the diameter-enlarged portion 352*d* are connected by a shoulder portion 352*h* having a tapered surface 352*e* on an outer surface thereof.

This ferrule 352 is attached to a tip end region of the lead releasing unit body 340*a* in the state of being retained by the holding member 340*b* and slidable in the axial direction of the body cylinder 310. Specifically, the holding member 340*b* includes a tubular body portion 340*c* which surrounds the rear region 352*b* of the ferrule 352, and an annular stopper 340*d* which is internally fitted to a rear end region of the body portion 340*c* as illustrated in FIGS. 7 to 9. With such a configuration, the ferrule 352 is held inside the holding member 340*b* so as to be slidable in the axial direction of the body portion 340*c* and is prevented from undesirably falling out of the body portion 340*c*. In addition, a front end of the body portion 340*c* is formed as an opening portion, and the front region 352*a* of the ferrule 352 protrudes forward from this opening portion.

As illustrated in FIGS. 7 to 9, a tapered surface is formed on an outer surface of a front region of the body portion 340*c* as a pressed portion 353 tapered toward the front side in the axial direction of the body cylinder 310. Further, the body portion 340*c* has a diameter-reduced portion 340*e* having a smaller inner diameter than the other region of the body portion 340*c* is provided on the inner surface thereof. A flat surface 345*f* facing the front side in the axial direction is formed on an outer surface of an outer cylinder 345 on the rear side in the axial direction of this diameter-reduced portion 340*e*, and a stretchable spring 355 in a compressed state is arranged between the small diameter portion 352*c* and the flat surface 345*f*. Other configurations are the same as those of the first embodiment. The same components as those of the first embodiment are denoted by substantially the same reference numerals in FIGS. 7 to 9, and a detailed description thereof will be omitted.

Next, an operation of the mechanical pencil 300 of the present embodiment will be described.

In the mechanical pencil 300 of the present embodiment, the writing lead 370 is released as a click portion 348 (knob 381) is pressed (clicked) to the front side in the axial direction in a state where a front end of the ferrule 352 is directed downward, which is similar to the first embodiment.

Then, writing is performed as a user grasps a front shaft 330 and moves the body cylinder 310 as desired while causing the writing lead 370 to abut on the paper surface.

At the time of writing, generally, writing pressure containing a component vertical to the axial direction of the body cylinder 310 and a component in the axial direction is applied to the writing lead 370 as described above. The mechanical pencil 300 of the present embodiment also absorbs each of the component vertical to the axial direction and the component in the axial direction of the writing pressure when high writing pressure is applied to the writing lead 370 at the time of writing, thereby avoiding breakage of the writing lead 370 exposed from the tip end of the ferrule 352, which is similar to the first embodiment.

Specifically, the front region of the lead releasing unit 340 is tilted by the component vertical to the axial direction of the writing pressure, and the pressed portion 353 of the holding member 340*b* is pressed to the rear side in the axial direction of the body cylinder 310 by the pressing portion 332 of the front shaft 330 as illustrated in FIG. 8. Accordingly, the lead releasing unit 340 including the writing lead 370 is relatively moved to the rear side in the axial direction with respect to the body cylinder 310 against a biasing force of the coil spring 360. On the other hand, the ferrule 352 is biased to the front side in the axial direction with respect to the holding member 340*b* by a biasing force of the spring 355, and thus, is not relatively moved to the rear side in the axial direction with respect to the body cylinder 310. As a result, the length of the writing lead 370 exposed from the tip end of the ferrule 352 is decreased.

At the same time, the writing lead 370 can be pressed to the rear side in the axial direction with respect to the body cylinder 310 by the component in the axial direction of the writing pressure. Accordingly, the lead releasing unit 340 including the writing lead 370 is further relatively moved to the rear side in the axial direction against the biasing force of the coil spring 360. That is, the length of the writing lead 370 exposed from the tip end of the ferrule 352 can be further decreased, and the breakage of the writing lead 370 is avoided.

Then, when the writing pressure applied to the writing lead 370 is weakened, the lead releasing unit 340 including the writing lead 370 is pushed back to the front side in the axial direction with respect to the body cylinder 310 by the biasing force of the coil spring 360. Accordingly, the initial state (see FIG. 7) is restored.

In this case, the ferrule 352 does not undesirably fall out of the lead releasing unit 340 at the time of assembling or disassembling of the mechanical pencil 300 of the present embodiment, and thus, workability is favorable. Specifically, the ferrule 352 of the present embodiment is internally fitted to the holding member 340*b* in advance prior to screwing the front shaft 330 and a rear shaft 320 as illustrated in FIG. 9, and in this state, the stopper 340*d* is internally fitted and fixed to a rear end of the body portion 340*c* of the holding member 340*b*. Accordingly, the ferrule 352 is held in the holding member 340*b* so as to be slidable in the axial direction of the body cylinder 310, and is not undesirably detached from the holding member 340*b*.

As illustrated in FIG. 9, the holding member 340*b* in which the ferrule 352 is internally fitted is inserted from an opening portion at the rear end of the front shaft 330, and is moved forward until the front region 352*a* of the ferrule 352 protrudes from the opening portion at the front end of the front shaft 330. Then, the rear shaft 320 with which the lead releasing unit 340 is assembled is screwed to the front shaft 330.

The above-described ferrule 352 is not undesirably detached from the holding member 340*b* even when disassembling the mechanical pencil 300 during maintenance or the like.

Even with the present invention as above, when the high writing pressure is applied to the writing lead 370, the front region of the lead releasing unit 340 is tilted inside the body cylinder 310 due to the component vertical to the axial direction of the writing pressure. In this manner, the lead releasing unit 340 including the writing lead 370 is relatively moved to the rear side in the axial direction with respect to the body cylinder 310 against the biasing force of the coil spring 360, and thus, the length of the writing lead 370 exposed from the tip end of the ferrule 352 is decreased. Further, the lead releasing unit 340 including the writing lead 370 is further relatively moved to the rear side in the axial direction with respect to the body cylinder 310 against the biasing force of the coil spring 360 due to the component in the axial direction of the writing pressure so that the length of the writing lead 370 exposed from the tip end of the ferrule 352 is further decreased. As a result, the breakage of the writing lead 370 can be avoided when the high writing pressure is applied to the writing lead 370. In addition, at this time, the ferrule 352 is not relatively moved (pops out) to the front side in the axial direction with respect to the body cylinder 310, but the lead releasing unit 340 including the writing lead 370 is relatively moved to the rear side in the axial direction with respect to the ferrule 352 so that the length of the writing lead 370 exposed from the ferrule 352 is decreased. Thus, when the tip end of the ferrule 352 and the paper surface abut on each other, the length of the writing lead 370 exposed from the ferrule 352 is rapidly increased by the biasing force of the coil spring 360 only by slightly weakening the writing pressure, and thus, it is possible to rapidly eliminate the contact between the tip end of the ferrule 352 and the paper surface.

In addition, the ferrule 352 of the present embodiment is arranged in the tip end region of the lead releasing unit 340, and is relatively movable in the axial direction of the body cylinder 310 with respect to the lead releasing unit 340. Further, the lead releasing unit 340 includes the lead releasing unit body 340*a* whose front end portion is surrounded by the ferrule 352, and the holding member 340*b* which is configured to hold the ferrule 352 in the lead releasing unit body 340*a* in the retained state. Thus, the ferrule 352 does not undesirably fall out of the lead releasing unit 340 at the time of assembling or disassembling of the mechanical pencil 300, and workability is favorable.

In particular, the holding member 340*b* is tubular and has the diameter-reduced portion 340*e* on the inner surface thereof, and the ferrule 352 has the diameter-enlarged portion 352*d* that is larger in diameter than the inner diameter of the diameter-reduced portion 340*e* on the outer surface of the body cylinder 310 on the rear side in the axial direction of the diameter-reduced portion 340*e*. With such a configuration, it is possible to reliably prevent the ferrule 352 from falling out of the holding member 340*b*.

In addition, it is easy to provide the pressed portion 353 at a desired position since the tapered surface as the pressed portion 353 is provided on the holding member 340*b*.

Figure 11:
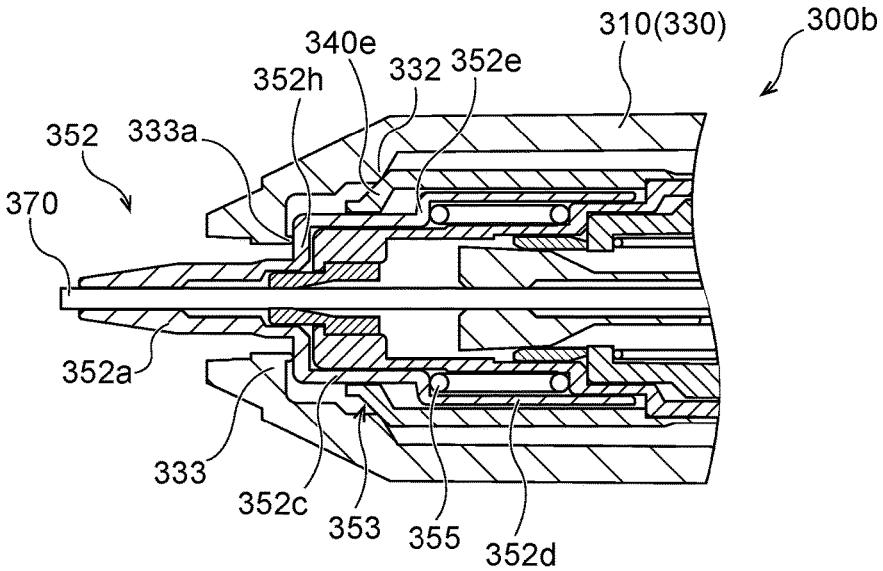
FIG. 11 is a partial schematic vertical cross-sectional view illustrating another modification of the mechanical pencil of FIG. 7.
Figure 12:
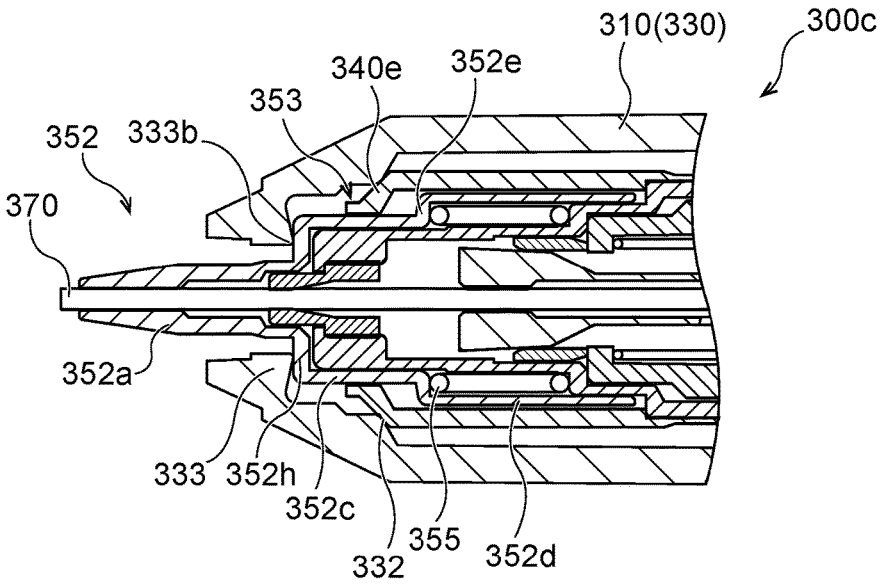
FIG. 12 is a partial schematic vertical cross-sectional view illustrating a still another modification of the mechanical pencil of FIG. 7.

Incidentally, it is possible to provide a smoother feel when the lead releasing unit 340 relatively moves to the rear side in the axial direction with respect to the body cylinder 310 by reducing frictional resistance of a contact portion between the ferrule 352 and an inner brim 333 of the front shaft 330 in the third embodiment described above. For example, the contact portion between the ferrule 352 and the inner brim 333 of the front shaft 330 is preferably configured to be point-contact or line-contact with each other in order to reduce the frictional resistance. An example of such a mechanical pencil will be described with reference to FIGS. 10 to 12. Each of FIGS. 10 to 12 is a schematic vertical cross-sectional view partially illustrating a modification of the mechanical pencil 300 according to the third embodiment of FIG. 7.

Figure 10:
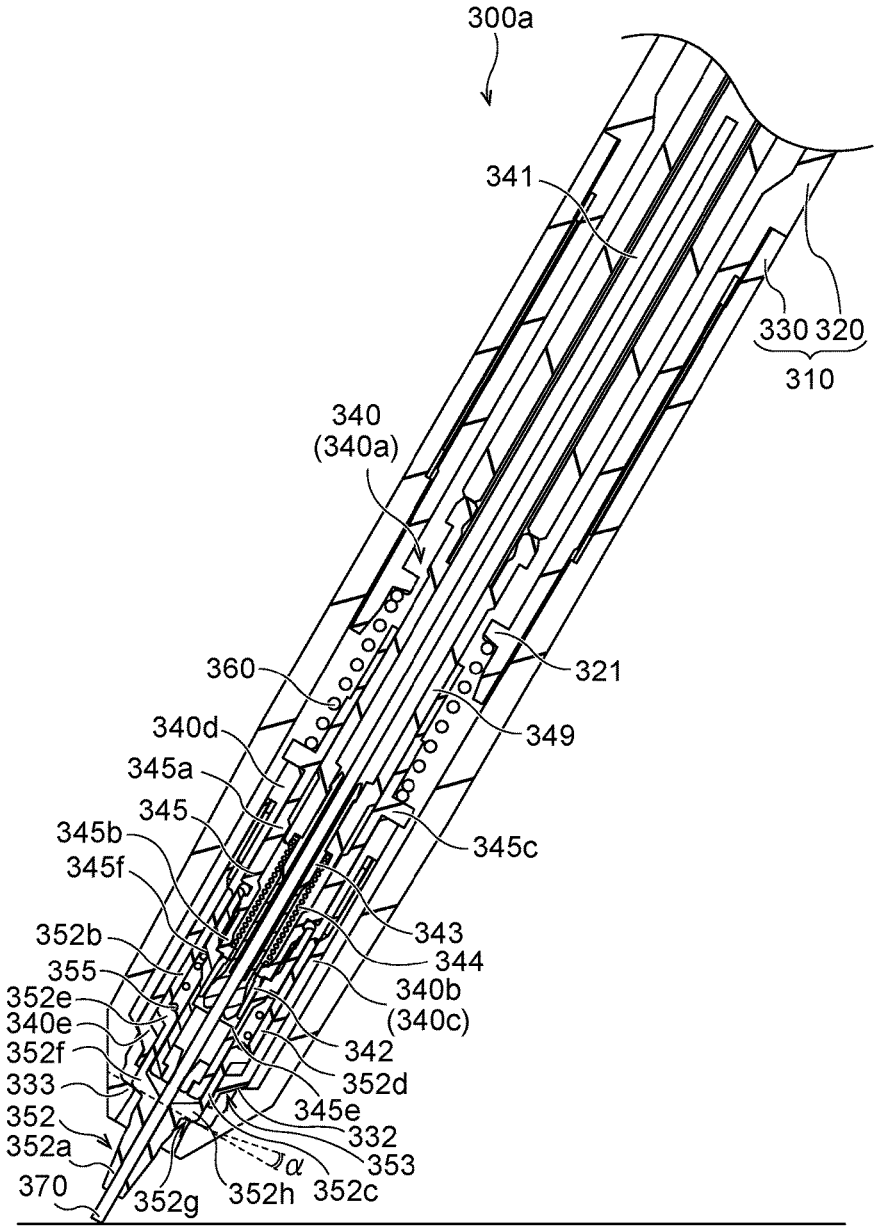
FIG. 10 is a partial schematic vertical cross-sectional view illustrating a modification of the mechanical pencil of FIG. 7.

In a mechanical pencil 300*a* according to the modification illustrated in FIG. 10, the front region 352*a* and the small diameter portion 352*c* of the ferrule 352 are connected by a shoulder portion 352*h* having a second tapered surface 352*g* on an outer surface thereof. The second tapered surface 352*g* increases in diameter toward the rear side in the axial direction of the body cylinder 310, and forms an angle $\alpha$ with respect to a plane orthogonal to the axial direction of the body cylinder 310 as illustrated in the drawing. The angle $\alpha$ is preferably any value in a range of 5° or larger and 20° or smaller, more preferably any value in a range of 8° or larger and 15° or smaller, and still more preferably any value in a range of 10° or larger and 13° or smaller. The angle α in the present embodiment is 11.31°. Meanwhile, the front shaft 330 has the inner brim 333 that overhangs inwardly in the radial direction of the body cylinder 310 on the front side in the axial direction of the body cylinder 310 than the second tapered surface 352*g*. A region of the inner brim 333 facing the second tapered surface 352*g* has the plane orthogonal to the axial direction of the body cylinder 310. With such a configuration, the inner brim 333 abuts on the second tapered surface 352*g* only in a region on the inner side in radial direction. Since other configurations are the same as those of the third embodiment, a detailed description thereof will be omitted.

As understood from the above configuration, the contact area between the inner brim 333 and the second tapered surface 352*g* of the mechanical pencil 300*a* according to the present modification is extremely small. Thus, a frictional force acting between the inner brim 333 and the second tapered surface 352*g* is greatly reduced as compared to a case where the second tapered surface 352*g* is not provided on the shoulder portion 352*h*, that is, a case where the angle α is 0°. Therefore, the operation when the front region of the lead releasing unit 340 is tilted by the component vertical to the axial direction of the writing pressure becomes smooth. Accordingly, it is possible to provide the smooth feel when the lead releasing unit 340 including the writing lead 370 relatively moves to the rear side in the axial direction with respect to the body cylinder 310. Further, the angle α is not so large when being 11.31°, and thus, the ferrule 352 does not greatly move to the rear side in the axial direction when the lead releasing unit 340 relatively moves to the rear side in the axial direction with respect to the body cylinder 310 so that there is no significant decrease in writing feeling.

Although it is configured such that the frictional force acting between the inner brim 333 and the ferrule 352 is reduced by providing the second tapered surface 352*g* on the ferrule 352 in the modification described above, it may be configured such that the frictional force is reduced by providing a protrusion or a tapered surface on the inner brim 333 instead of the ferrule 352. FIGS. 11 and 12 illustrate such a modification.

In a mechanical pencil 300*b* according to the modification of FIG. 11, the shoulder portion 352*h* of the ferrule 352 is configured to have a plane orthogonal to the axial direction of the body cylinder 310 instead of the second tapered surface 352*g*. Meanwhile, a protrusion 333*a* that protrudes toward the rear side in the axial direction is formed in a region of the inner brim 333 facing the shoulder portion 352*h*. The protrusion 333*a* may be a ridge that is continuously or intermittently formed in a circumferential direction of the inner brim 333 or a plurality of point-shaped protrusions provided at intervals in the circumferential direction of the inner brim 333. With such a configuration, the inner brim 333 abuts on the shoulder portion 352*h* of the ferrule 352 only at a tip end portion of the protrusion 333*a*. Since other configurations are the same as those of the third embodiment, a detailed description thereof will be omitted.

Even with the above configuration, the contact area between the inner brim 333 and the shoulder portion 352*h* can be made extremely small. Thus, the frictional force acting between the inner brim 333 and the shoulder portion 352*h* is greatly reduced, which is similar to the modification illustrated in FIG. 10. Therefore, the operation when the front region of the lead releasing unit 340 is tilted by the component vertical to the axial direction of the writing pressure becomes smooth when using the mechanical pencil 300*b*. Accordingly, it is possible to provide the smooth feel when the lead releasing unit 340 including the writing lead 370 relatively moves to the rear side in the axial direction with respect to the body cylinder 310 even in the present modification.

Alternatively, the shoulder portion 352*h* of the ferrule 352 is configured to have a plane orthogonal to the axial direction of the body cylinder 310 in a mechanical pencil 300*c* according to the modification of FIG. 12, which is similar to the mechanical pencil 300*b* according to the modification of FIG. 11. Meanwhile, the inner brim 333 has a third tapered surface 333*b*, which increases in diameter toward the front side in the axial direction of the body cylinder 310, in a region facing the shoulder portion 352*h*. That is, a surface of the inner brim 333 that faces the shoulder portion 352*h* is tilted such that a radially inward region of the body cylinder 310 is positioned on the rear side in the axial direction of the body cylinder 310. A protrusion protruding toward the shoulder portion 352*h* is formed in the radially inner region of the body cylinder 310 due to such tilting (the third tapered surface 333*b*). With such a configuration, the inner brim 333 abuts on the shoulder portion 352*h* of the ferrule 352 only at the radially inward part of the body cylinder 310 on the third tapered surface 333*b*. Since other configurations are the same as those of the third embodiment, a detailed description thereof will be omitted.

Even with the above configuration, the contact area between the inner brim 333 and the shoulder portion 352*h* can be made extremely small. Thus, the frictional force acting between the inner brim 333 and the shoulder portion 352*h* is greatly reduced, which is similar to the modification illustrated in FIG. 10. Therefore, the operation when the front region of the lead releasing unit 340 is tilted by the component vertical to the axial direction of the writing pressure becomes smooth when using the mechanical pencil 300*c*. Accordingly, it is possible to provide the smooth feel when the lead releasing unit 340 including the writing lead 370 relatively moves to the rear side in the axial direction with respect to the body cylinder 310 even in the present modification.

Incidentally, the lead releasing unit 340 may be configured to be flexurally deformed instead of tilting. Even in this case, it is possible to cause the lead releasing unit 340 to be relatively moved to the rear side in the axial direction with respect to the body cylinder 310 due to the writing pressure vertical to the axial direction of the body cylinder 310. This flexural deformation can be realized, for example, by forming the lead pipe 341 using a flexible material.

In addition, the swing-type lead releasing unit can be adopted even in the present embodiment.

The invention claimed is:

1. A mechanical pencil comprising:

a body cylinder;

a lead releasing unit which is configured to release a writing lead and has a rear region that is supported inside the body cylinder such that a front region thereof is flexurally deformable or tiltable inside the body cylinder;

an overhanging portion provided on an outer circumferential surface of the front region of the lead releasing unit;

a protruding portion provided on an inner circumferential surface of the body cylinder on a rear side in an axial direction as compared to the overhanging portion; and a stretchable elastic body arranged in a compressed state between the overhanging portion and the protruding portion, wherein the lead releasing unit has a pressed portion on the outer circumferential surface of the front region, the body cylinder has a pressing portion in a front region, at least one of the pressing portion and the pressed portion is a tapered surface which gradually increases in diameter toward the rear side in the axial direction, and the pressing portion and the pressed portion abut on each other before the front region of the lead releasing unit is flexurally deformed or tilted inside the body cylinder, and the pressing portion causes the pressed portion to relatively move to the rear side in the axial direction with respect to the body cylinder when the front region of the lead releasing unit is flexurally deformed or tilted inside the body cylinder.

2. The mechanical pencil according to claim 1, wherein the pressed portion of the lead releasing unit is the tapered surface, and the tapered surface has any angle between 20° and 60° with respect to the axial direction of the body cylinder, the elastic body is a coil spring, and a load, necessary to relatively move the pressed portion to the rear side in the axial direction with respect to the body cylinder against a biasing force of the coil spring, is any value between 0.5 N and 8 N.

3. The mechanical pencil according to claim 1, wherein, the pressed portion of the lead releasing unit is the tapered surface, and the tapered surface has any angle between 20° and 60° with respect to the axial direction of the body cylinder, the elastic body is configured by arranging a first coil spring and a second coil spring in series, a load, necessary to relatively move the pressed portion to the rear side in the axial direction with respect to the body cylinder against a biasing force of the first coil spring, is any value between 0.5 N and 5 N, and a load, necessary to relatively move the pressed portion to the rear side in the axial direction with respect to the body cylinder against a biasing force of the second coil spring, is any value between 2 N and 10 N.

4. The mechanical pencil according to claim 1, wherein, the lead releasing unit includes: a lead pipe which extends in the axial direction of the body cylinder inside the body cylinder; a connector which is fixed to a front end portion of the lead pipe and has a protrusion formed on an outer circumferential surface thereof; a chuck which is fixed to a front end portion of the connector; a fastening ring which is externally fitted to a front region of the chuck; a return spring which biases the connector to the rear side in the axial direction; and a weight body which is provided so as to be loosely fitted to an outer circumference of the lead pipe in a space portion formed between the body cylinder and the lead pipe, and the weight body is configured to move back and forth inside the space portion when the body cylinder is swung back and forth and to abut on the protrusion of the connector on a front side.

5. The mechanical pencil according to claim 1, further comprising a ferrule which is arranged in a tip end region of the lead releasing unit and capable of relatively moving in the axial direction of the body cylinder with respect to the lead releasing unit, wherein the lead releasing unit includes a lead releasing unit body whose front end portion is surrounded by the ferrule, and a holding member which is configured to hold the ferrule in the lead releasing unit body in a retained state.

6. The mechanical pencil according to claim 5, wherein the holding member is tubular and has a diameter-reduced portion on an inner surface thereof, and the ferrule has a diameter-enlarged portion that is larger in diameter than an inner diameter of the diameter-reduced portion on an outer surface of the body cylinder on the rear side in the axial direction than the diameter-reduced portion.

7. The mechanical pencil according to claim 5, wherein the pressed portion is provided in the holding member.

8. The mechanical pencil according to claim 5, wherein the ferrule includes:

a tubular front region, which protrudes to a front side in the axial direction from a front end of the body cylinder and surrounds the writing lead released from the lead releasing unit; and a shoulder portion which is provided in the front region on the rear side in the axial direction of the body cylinder and widened outwardly in a radial direction of the body cylinder, the body cylinder has an inner brim which overhangs inwardly in the radial direction of the body cylinder on the front side in the axial direction of the body cylinder than the shoulder portion, and the shoulder portion and the inner brim are in point-contact or line-contact with each other.

9. The mechanical pencil according to claim 8, wherein the shoulder portion is a second tapered surface which increases in diameter toward the rear side in the axial direction of the body cylinder, and the second tapered surface and the inner brim abut on each other.

10. The mechanical pencil according to claim 9, wherein the second tapered surface has an angle of 5° or larger and 20° or smaller with respect to a plane orthogonal to the axial direction of the body cylinder.

11. The mechanical pencil according to claim 8, wherein the inner brim has a protrusion protruding toward the rear side in the axial direction of the body cylinder and abutting on the shoulder portion, and the protrusion and the shoulder portion abut on each other.

12. The mechanical pencil according to claim 8, wherein the inner brim has another tapered surface, which increases in diameter toward the front side in the axial direction of the body cylinder, in a region facing the shoulder portion, and the another tapered surface and the shoulder portion abut on each other.

* * * * *